United States Patent [19]

Stapp

[11] Patent Number: 4,552,646

[45] Date of Patent: Nov. 12, 1985

[54] DEARSENATING OF SHALE OIL WITH METAL CHLORATES

[75] Inventor: Paul R. Stapp, Bartlesville, Okla.

[73] Assignee: Phillips Petroleum Company, Bartlesville, Okla.

[21] Appl. No.: 685,413

[22] Filed: Dec. 24, 1984

[51] Int. Cl.[4] ..... C10G 25/06; C10G 17/02; C10G 17/04; C10G 17/09

[52] U.S. Cl. ..... 208/90; 208/88; 208/91; 208/87; 208/211; 208/252; 208/253

[58] Field of Search ..... 208/252, 253, 49, 90, 208/91, 87, 88

[56] References Cited

U.S. PATENT DOCUMENTS

| | | | |
|---|---|---|---|
| 2,704,738 | 3/1955 | Simpson | 196/14.12 |
| 2,778,779 | 1/1957 | Donaldson | 196/50 |
| 2,781,297 | 2/1957 | Appell | 196/44 |
| 2,944,965 | 7/1960 | Mirabile | 208/253 |
| 3,876,533 | 4/1975 | Myers | 208/251 H |
| 4,151,068 | 4/1979 | McCollum | 208/11 LE |
| 4,431,524 | 2/1984 | Norman | 208/252 |

OTHER PUBLICATIONS

"Comprehensive Inorganic Chemistry", J. C. Bailar et al., Pergamon Press, 1973, pp. 667 and 670.

"Lehrbuch der Anorganischen Chemie", A. F. Holleman and E. Wiberg, Walter De-Gruyter & Co., 1955, p. 276.

*Primary Examiner*—D. E. Gantz

*Assistant Examiner*—Chung K. Pak

*Attorney, Agent, or Firm*—French and Doescher

[57] ABSTRACT

Arsenic impurities and, optionally, iron impurities are removed from a hydrocarbon-containing feed stream, preferably shale oil, by contacting it with an aqueous solution of a metal chlorate and an acid having a pKa of less than 3.

25 Claims, No Drawings

DEARSENATING OF SHALE OIL WITH METAL CHLORATES

BACKGROUND OF THE INVENTION

This invention relates to the purification of hydrocarbon-containing feed streams which contain undesirable contaminants. In accordance with another aspect, this invention relates to the extraction of hydrocarbon-containing feed streams to remove therefrom arsenic impurities. In another aspect, this invention relates to the use of aqueous solutions of oxidizing agents for the removal of arsenic and metallic contaminants from various hydrocarbon-containing feed streams, particularly shale oil.

There is an ever present need for the treatment of various hydrocarbon feed streams such as shale oil to remove undesirable components such as arsenic and metals therefrom. The removal of these impurities improves the processability of these hydrocarbon streams in subsequent operations, e.g., those employing catalysts that are easily deactivated by arsenic and metals. If arsenic and metal impurities are not substantially removed prior to operations such as catalytic hydrotreating, hydrocracking and cracking, arsenic and metals are deposited on these catalysts and the catalyst life is shortened.

SUMMARY OF THE INVENTION

It is an object of this invention to provide a process for the purification of hydrocarbon-containing feed streams, which contain arsenic impurities. It is another object of this invention to provide a process for the removal of arsenic impurities from shale oil. It is a further object of this invention to provide a process for the purification of hydrocarbon-containing feed streams, particularly shale oils, which contain arsenic and iron impurities. It is still another object of this invention to provide a process for removing at least a portion of arsenic and, optionally, iron contained in hydrocarbon-containing feed streams by extraction with an aqueous extractant. It is a further object of this invention to produce a hydrocarbon-containing stream having a reduced level of arsenic. It is a still further object of this invention to produce a hydrocarbon-containing stream having a reduced level of arsenic and iron.

It is still another object of this invention to improve the processability of hydrocarbon-containing streams by reducing their arsenic levels. It is a still further objective of this invention to improve the processability of shale oil having a reduced arsenic content, optionally blended with other hydrocarbon-containing streams such as petroleum-derived materials, in subsequent processes such as hydrotreatment, catalytic cracking and the like. Other objects and advantages will be apparent from the detailed description and the appended claims.

In accordance with the instant invention, a hydrocarbon-containing feed stream containing arsenic impurities and, optionally, iron impurities is contacted with an aqueous extractant/reactant containing (a) at least one substantially dissolved metal chlorate and (b) at least one substantially dissolved acid having an ionization constant higher Ka than $1\times10^{-3}$, i.e., a pKa ($-\log$ Ka) of less than 3, under suitable conditions so as to produce a hydrocarbon-containing stream having a reduced content of arsenic and, optionally a reduced content of iron. The hydrocarbon feed stream and the aqueous extractant solutions are substantially immiscible. The acidified metal chlorate solution functions as an agent for oxidizing arsenic and, optionally, iron to substantially water-soluble arsenic and iron compounds, preferably at an elevated temperature. Removal of arsenic and, optionally, iron impurities from a hydrocarbon-containing stream, particularly shale oil, provides for improved processability in subsequent processes such as hydrodesulfurization, hydrogenation and catalytic cracking. Optionally, shale oil that has been treated in accordance with this invention can be blended with at least one petroleum-derived hydrocarbon stream before treatment in said subsequent processes.

DETAILED DESCRIPTION OF THE INVENTION

Any hydrocarbon-containing feed stream, which contains arsenic impurities and, optionally, iron impurities, can be treated in accordance with the process of this invention. Suitable feed streams are crude oils, crude oil fractions, petroleum products, coal pyrolyzates, products from the extraction and/or liquefaction of coal and lignite, products from tar sands and, most particularly, shale oils and products or fractions of shale oil. The term "shale oil" is used hereinafter for hydrocarbon-containing materials produced by pyrolysis, hydroretorting and/or extraction of kerogen-containing materials such as oil shale. Raw shale oil, the preferred hydrocarbon-containing feed stream of this invention, generally contains about 1–200, more particularly about 5–100, ppmw (parts per million by weight) arsenic; about 0.1–3, more particularly 0.2–2, weight percent sulfur; about 0.2–5, more particularly about 0.3–3, weight percent total nitrogen; about 5–300, more particularly about 10–200, ppm metals, mainly iron, nickel and vanadium. The API gravity of the shale oil feed generally ranges from about 5 to about 50, preferably from about 15 to about 35. The shale oil can be derived by any known process (e.g., retorting, hydroretorting, extracting and the like) from a kerogen-containing mineral such as oil shale. It is within the scope of this invention to use any fraction or product of shale oil, e.g., a fraction which boils at above 400° F., and to use pretreated shale oil.

Arsenic impurities contained in the hydrocarbon-containing feed streams can be elemental arsenic, inorganic arsenic compounds such as arsenic oxides, arsenic sulfides, metal arsenides, arsenous and arsenic acids, metal arsenites and arsenates, metal thioarsenites and thioarsenates; and organic arsenic compounds such as alkyl-, cycloalkyl and aryl-substituted arsines (e.g., tris(4-methylphenyl)arsine), arsolanes, arsoles, arsanes, arsenines, arsepanes, diarsocanes, arsonanes, arsenomethane, alkyl-, cycloalkyl- and aryl-substituted arsenic halides, hydroxyarsines, oxybis(secondary arsines), alkyl- or phenylarsine oxides, arsinic acids, arsonic acids, oxoarsines, arsenite and arsenate esters and the like, as described in Comprehensive Inorganic Chemistry, by J. C. Bailor et al., Pergamon Press, 1973, Volume 2, pages 547–683. Specific arsenic compounds contained in shale oils include methylarsonic acid, phenylarsonic acid, dimethylarsinic acid, and sodium arsenate.

Iron impurities optionally contained in hydrocarbon-containing feed stream can be elemental iron (e.g., tramp iron); inorganic iron (II) and (III) compounds such as oxides, hydroxides, halides, sulfides, sulfites, sulfates, phosphates, arsenites, arsenates, silicates, and the like; and organic iron compounds such as iron (II)

and iron (III) carboxylates, ferrocene-type complexes, diolefin-carbonyl complexes acetylene-carbonyl complexes, dipyridyl complexes, cyano complexes and arsino complexes of iron as well as iron porphyrin compounds. It is presently believed that most iron compounds contained in shale oil are iron (II) carboxylates.

Metal chlorates suitable for the treating/extracting process of this invention can be metal chlorate which is at least partially soluble in water such as $NH_4ClO_3$, $LiClO_3$, $NaClO_3$, $KClO_3$, $Mg(ClO_3)_2$, $Ca(ClO_3)_2$, $Sr(ClO_3)_2$, $Ba(ClO_3)_2$, $Fe(ClO_3)_2$, $Co(ClO_3)_2$, $Ni(ClO_3)_2$, $Cu(ClO_3)_2$, $Pb_2(OH)_2(ClO_3)_2$ and the like. The presently preferred metal chlorate is $NaClO_3$, mainly because it is commercially available.

Acids suitable for the treating/extracting process of this invention can be any acidic species having an ionization constant of higher than $1\times10^{-3}$, i.e., a pKa of less than 3. Examples of such acids are HCl, $HClO_4$, HBr, $HNO_3$, $H_2SO_4$, $NaHSO_4$, $KHSO_4$, $H_2SO_5$, $H_3PO_4$, oxalic acid, trichloroacetic acid, trifluoroacetic acid, naphthalene sulfonic acid and the like. Presently preferred is $H_2SO_4$.

The aqueous extractant solution of this invention can be prepared in any manner. The acid and the metal chlorate can be added essentially simultaneously or sequentially, in any order, to water for dissolution, preferably with agitation. Or the acid and the metal chlorate can be dissolved in two separate aqueous solutions, which are then combined. The aqueous solution containing an acid and a metal chlorate can, prior to its use in the process in this invention, undergo a separation step such as filtration or centrifugation, e.g., for removing a dispersed, substantially insoluble salt that may have been formed in the combination of the acid and the soluble metal chlorate (e.g., when $Ba(Cl0_3)_2$ and $H_2SO_4$ are combined to at least partially form insoluble $BaSO_4$ and dissolved $HClO_3$).

The concentration of the acid dissolved in the aqueous reactant generally ranges from about 0.01 N (g-equivalents per liter) to about 5 N, preferably from about 0.1 N to about 1 N. The concentration of the metal chlorate in the aqueous extractant is chosen so as to provide from about 0.01 to about 5 mole/liter of of the $ClO_3$ group (either as $ClO_3^-$ anion or in the form of $HClO_3$), preferably from about 0.1 to about 1 mole/liter of the $ClO_3$ group. The ratio of the number g-equivalents of the acid to the number of moles $ClO_3$ generally ranges from about 0.1:1 to about 10:1.

Any suitable amount of a substantially dissolved metal chlorate to the hydrocarbon-containing feed stream can be utilized that results in a reduction in the level of arsenic, and optionally iron, in the hydrocarbon-containing feed stream under the specific reaction conditions. Generally the ratio of the number of millimoles of the $ClO_3$ group (as $ClO_3^-$ ion or bound in $HCl0_3$) to the number of grams of hydrocarbon-containing feed stream generally ranges from about 0.01:1 to about 100:1, preferably from about 0.1:1 to about 10:1.

The dearsenating process of this invention can be carried out by means of any apparatus, whereby there is achieved an intimate contact of the aqueous, acidic chlorate-containing extractant with the hydrocarbon-containing feed stream, under suitable dearsenating conditions. The process is in no way limited to the use of a particular apparatus. The process can be carried out as a continuous operation or as a batch process. The terms hydrocarbon-containing feed stream and hydrocarbon stream (or hydrocarbon material) are used herein to refer to both continuous and batch processes.

The hydrocarbon-containing feed stream and the aqueous extractant/reactant can be introduced into a reactor in any suitable manner. The hydrocarbon stream and the aqueous extractant can be introduced essentially simultaneously into the reactor and then mixed in the reactor so as to afford intimate contact between the two substantially immiscible phases so as to form an intimate two-phase liquid mixture. The mixing can be accomplished by mechanical agitation or by passage through static mixing devices such as baffle plates installed in the reactor. The hydrocarbon feed stream and water can also be premixed in a separate mechanical mixing vessel or in a vessel with circulating pumping action, or in a static mixing device, and then fed as one substantially premixed liquid stream into the reactor so as to produce a hydrocarbon effluent material having a reduced As content, and optionally, also a reduced Fe content. In batch processes, the hydrocarbon feed stream and the aqueous extractant can be added to the reactor sequentially in any order before or while being agitated. Countercurrent extraction of the hydrocarbon-containing feed stream with the aqueous metal chlorate-containing extractant can also be employed, and is a preferred mode in continuous operations.

Any suitable reaction time, i.e., time of intimate contact between the aqueous extractant, which contains at least one acid having an ionization constant of at least $1\times10^{-3}$ and at least one metal chlorate, and the hydrocarbon-containing feed stream can be utilized. In general, the reaction time will range from about 0.05 hours to about 50 hours. Preferably, the reaction time will range from about 0.1 to about 25 hours. Thus, the flow rate of the hydrocarbon-containing feed stream should be such that the time required for the passage of the mixture through the reactor (residence time) will preferably be in the range of about 0.1 to 25 hours. One can, at any time during the process, monitor the arsenic content in the hydrocarbon raffinate stream, and determine when no more appreciable amount of arsenic is removed from the hydrocarbon stream and when the extraction should be ceased. Thereby the process of this invention can be controlled and automatized.

The dearsenating process of the present invention can be carried out at any suitable temperature. The temperature will generally be in the range of about 10° C. to about 200° C. and will preferably be in the range of about 20° C. to about 100° C. Temperatures higher than 200° C. are generally not utilized, mainly because of economic considerations.

Any suitable pressure can be utilized in the dearsenating process of this invention. The reaction pressure will generally be in the range of up to about 500 psig. Preferably, the pressure will be in the range of about 0 to about 100 psig, depending on the operating temperature.

After a substantial removal of arsenic and, optionally, iron from the hydrocarbon-containing feed stream is achieved by the extraction with the extractant of this invention, the hydrocarbon-containing stream (first phase) now having a reduced arsenic content and, optionally, a reduced iron content and the aqueous extractant (second phase) now containing arsenic and, optionally iron, are generally separated. Any suitable separation technique can be employed such as centrifugation and settling plus subsequent draining of the lighter phase and/or the heavier phase. Decantation or draining technique is presently preferred.

If the dearsenating process of this invention is carried out in a refinery where hydrodesulfurization and/or hydrodenitrogenation is practiced because the hydrocarbon feed also contains sulfur and nitrogen impurities, the dearseniting and separation processes of this invention are generally employed before the hydrodesulfurization and/or hydrodenitrogenation steps. It is presently preferred to carry out the dearsenating process of this invention first and thereafter desulfurize and denitrogenate the hydrocarbon products having a reduced arsenic level and, optionally, a reduced iron level by a catalytic hydrotreating process, which generally removes more arsenic, iron, and other metals (e.g., vanadium and nickel), sulfur, nitrogen and carbon precursors.

A hydrocarbon material, preferably shale oil, which is at least partially dearsenated in accordance with this invention and then separated from the aqueous extractant by conventional separating means outlined above, can be blended with another suitable hydrocarbon stream such as crude oil, topped crude, resid, coal pyrolyzate, coal extract, tar sand extract and the like. Subsequently the entire blend can be treated in one or more hydrodemetallization, hydrodesulfurization, hydrodenitrogenation and cracking processes.

The at least partially dearsenated hydrocarbon material, preferably shale oil, can also be fed directly to a cracking unit, e.g., a fluidized catalytic cracker, where it is heated under suitable cracking conditions and converted to gasoline and other useful fuel products. The at least partially dearsenated hydrocarbon stream can also first be further demetallized and/or desulfurized and/or denitrogenated as outlined above, optionally as a blend with at least one other hydrocarbon-containing stream (e.g., a petroleum-derived material), and then be charged to a cracking unit where it is heated under cracking conditions so as to produce gasoline and other useful products.

The following examples are presented to further illustrate the invention, without unduly limiting the scope of this invention.

EXAMPLE

This example illustrates the treatment of a shale oil with aqueous solutions of various oxidizing agents for the removal of arsenic impurities. The shale oil used for the tests was a Paraho Western Shale Oil containing 31.6 ppm As, 60 ppm Fe, 3.0 ppm Ni, 1.1 ppm V, about 0.8 weight-% S and about 2.1 weight-% total N.

Mixtures of 50 grams of the raw shale oil and 100 mL of toluene were mixed with acidified aqueous solutions of various oxidants. The combined mixture was heated under reflux conditions for about 18–20 hours. The cooled mixture was then poured into a separatory funnel. The aqueous phase was discarded, and the oil phase was submitted for analyses. Fe and As were determined by atomic absorption analysis, S content was determined by x-ray fluorescence spectrometry, and N content was measured in accordance with ASTM D3228. Analysis results for the product of both runs are summarized in Table I.

TABLE I

| Run | Treating Agents[1] Acid | Oxidant | %-Removal of As | of Fe |
|---|---|---|---|---|
| 1 (Control) | 0 | 2% $H_2O_2$[3] | 44 | 7 |
| 2 (Control) | 0 | 2% $CuSO_4$ | 59 | 34 |
| 3 (Control) | 0.2% $H_2SO_4$ | 2% $Fe_2(SO_4)_3$ | 28 | 74 |
| 4 (Control) | 0.2% $H_2SO_4$ | 2% $Ce(NH_4)_2(SO_4)_3$ | 23 | 63 |
| 5 (Invention) | 0.2% $H_2SO_4$ | 2% $NaClO_3$ | 66 | 50 |
| 6 (Control) | 0.9% $H_2SO_4$ | 2% $Fe_2(SO_4)_3$ | 64 | 81 |
| 7 (Control) | 0.9% $H_2SO_4$ | 2% $Fe_2(SO_4)_3$ + 0.1% $V_2O_5$ | 58 | 89 |
| 8 (Invention) | 0.9% $H_2SO_4$ | 2% $NaClO_3$ | 79 | 100 |
| 9 (Invention) | 0.9% $H_2SO_4$ | 2% $NaClO_3$ + 0.1% $V_2O_5$ | 75 | 100 |
| 10 (Invention) | 0.9% $H_2SO_4$ | 4% $NaClO_3$ | 95 | 52[2] |
| 11 (Invention) | 1.8% $H_2SO_4$ | 2% $NaClO_3$ | 95 | 83 |
| 12 (Invention) | 3.6% $H_2SO_4$ | 2% $NaClO_3$ | 95 | 95 |
| 13 (Invention) | 3.6% $H_2SO_4$ | 2% $NaClO_3$ | 97 | 97 |

[1]all listed percentages are weight-%.
[2]analytical result is believed to be erroneous.
[3]not heated.

Data in Table I indicate that acidified $NaClO_3$ solutions unexpectedly were more effective in removing As than solutions of other oxidants of equal concentration of oxidant and acid. Generally, acidified solutions of $NaClO_3$ were as effective as or more effective than solutions of several other oxidants for Fe removal.

Reasonable variations and modifications can be made in this invention without departing from the spirit and scope thereof.

I claim:

1. A process for removing at least a portion of arsenic impurities from a hydrocarbon-containing feed stream, which contains arsenic impurities, comprising the step (A) of contacting said feed stream with an aqueous extractant, which comprises (a) at least one substantially dissolved metal chlorate, and (b) at least one acid having a pKa of less than 3, under suitable dearsenating conditions so as to produce a hydrocarbon-containing stream having a reduced level of arsenic.

2. A process in accordance with claim 1 wherein said hydrocarbon-containing feed stream is shale oil, which also contains iron impurities.

3. A process in accordance with claim 1 wherein in said aqueous extractant the concentration of the metal chlorate ranges from about 0.01 to about 5 mole/L of the $ClO_3$ group, and the concentration of the acid range from about 0.01 N to about 5 N.

4. A process in accordance with claim 3 wherein the concentration of the metal chlorate ranges from about 0.1 to about 1 mole/L of the $ClO_3$ group, and the concentration of the acid ranges from about 0.1 N to about 1 N.

5. A process in accordance with claim 4 wherein said hydrocarbon-containing feed stream is shale oil.

6. A process in accordance with claim 4 wherein said the ratio of the number of gram-equivalents of the acid to the number of moles of $ClO_3$ ranges from about 0.1:1 to about 10:1.

7. A process in accordance with claim 1 wherein the ratio of the number of millimoles of the $ClO_3$ group to the number of grams of hydrocarbon-containing feed stream ranges from about 0.1:1 to about 100:1.

8. A process in accordance with claim 7 wherein the ratio of the number of millimoles of the $ClO_3$ group to the number of grams of hydrocarbon-containing feed stream ranges from about 0.1:1 to about 10:1.

9. A process in accordance with claim 2 wherein the ratio of the number of millimoles of the $ClO_3$ group to the number of grams of hydrocarbon-containing feed stream ranges from about 0.01:1 to about 100:1.

10. A process in accordance with claim 9 wherein the ratio of the number of millimoles of the $ClO_3$ group to the number of grams of hydrocarbon-containing feed stream ranged from about 0.1:1 to about 10:1.

11. A process in accordance with claim 3 wherein the metal chlorate is $NaClO_3$ and the acid is $H_2SO_4$.

12. A process in accordance with claim 4 wherein the metal chlorate is $NaClO_3$ and the acid is $H_2SO_4$.

13. A process in accordance with claim 5 wherein the metal chlorate is $NaClO_3$ and the acid is $H_2SO_4$.

14. A process in accordance with claim 8 wherein the metal chlorate is $NaClO_3$ and the acid is $H_2SO_4$.

15. A process in accordance with claim 3 wherein the reaction time ranges from about 0.05 to about 50 hours, and the reaction temperature ranges from about 10° C. to about 200° C.

16. A process in accordance with claim 4 wherein the reaction time ranges from about 0.05 to about 50 hours, and the fraction temperature ranges from about 10° C. to about 200° C.

17. A process in accordance with claim 11 wherein the reaction time ranges from about 0.1 to about 5 hours, and the reaction temperature ranges from about 20° C. to about 100° C.

18. A process in accordance with claim 12 wherein the reaction time ranges from about 0.1 to about 5 hours, and the reaction temperature ranges from about 20° C. to about 100° C.

19. A process in accordance with claim 1 comprising the additional step (B) of separating the hydrocarbon-containing stream having a reduced level of arsenic from the aqueous extractant.

20. A process in accordance with claim 2 comprising the additional step (B) of separating the hydrocarbon-containing stream having a reduced level of arsenic from the aqueous extractant.

21. A process in accordance with claim 20 wherein said separating step (B) comprises settling and decanting.

22. A process in accordance with claim 20, wherein the hydrocarbon-containing stream having a reduced level of arsenic contains sulfur and nitrogen impurities, said process comprising the additional step (C) of subjecting said hydrocarbon-containing stream having a reduced level of arsenic to catalytic hydrotreating so as to remove at least a portion of sulfur and nitrogen impurities therefrom.

23. A process for reducing the arsenic content of an arsenic-containing hydrocarbon feed stream, said process comprising:

(A) contacting said feed stream with an aqueous extractant, which contains (a) at least one substantially dissolved metal chlorate and (b) at least one substantially dissolved acid having a pKa of less than 3, to form an intimate two-phase liquid mixture, (B) separating said two-phase liquid mixture first into a hydrocarbon material having reduced arsenic content (as compared to said hydrocarbon feed stream) and an aqueous stream, and then (C) recovering said hydrocarbon material having a reduced arsenic content.

24. A process in accordance with claim 23 comprising the additional step of (D) subjecting said hydrocarbon material having a reduced arsenic content to heating under cracking conditions so as to produce gasoline and other useful fuel products.

25. A process in accordance with claim 20 comprising the additional step of blending said hydrocarbon-containing stream having a reduced arsenic content with another hydrocarbon stream selected from the group consisting of crude oil, topped crude, resid, coal pyrolyzate, coal extract and tar sand extract.

* * * * *

UNITED STATES PATENT AND TRADEMARK OFFICE

CERTIFICATE OF CORRECTION

PATENT NO. : 4,552,646

DATED : November 12, 1985

INVENTOR(S) : Paul R. Stapp

It is certified that error appears in the above-identified patent and that said Letters Patent are hereby corrected as shown below:

7. A process in accordance with claim 1 wherein the ratio of the number of millimoles of the $ClO_3$ group to the number of grams of hydrocarbon-containing feed stream ranges from about 0.01:1 to about 100:1.

Signed and Sealed this

*Tenth* Day of *June 1986*

[SEAL]

*Attest:*

*Attesting Officer*

DONALD J. QUIGG

*Commissioner of Patents and Trademarks*